US009384929B2

(12) United States Patent
Masuda et al.

(10) Patent No.: US 9,384,929 B2
(45) Date of Patent: Jul. 5, 2016

(54) FUSE UNIT

(75) Inventors: Toshiko Masuda, Makinohara (JP); Tatsuya Aoki, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 502 days.

(21) Appl. No.: 13/638,117

(22) PCT Filed: Apr. 6, 2011

(86) PCT No.: PCT/JP2011/059122

§ 371 (c)(1),
(2), (4) Date: Sep. 28, 2012

(87) PCT Pub. No.: WO2011/126138

PCT Pub. Date: Oct. 13, 2011

(65) Prior Publication Data

US 2013/0027174 A1 Jan. 31, 2013

(30) Foreign Application Priority Data

Apr. 6, 2010 (JP) ..... 2010-087847

(51) Int. Cl.
*H01H 85/00* (2006.01)
*H01H 85/02* (2006.01)
*H01H 85/044* (2006.01)

(52) U.S. Cl.
CPC ..... *H01H 85/0241* (2013.01); *H01H 85/044* (2013.01); *H01H 2085/025* (2013.01)

(58) Field of Classification Search
CPC ..... H01H 85/0241; H01H 85/044; H01H 2085/025
USPC ..... 337/142, 187, 227, 295, 256, 159, 161
See application file for complete search history.

(56) References Cited

U.S. PATENT DOCUMENTS

| | | | | |
|---|---|---|---|---|
| 5,034,620 | A * | 7/1991 | Cameron | 307/10.7 |
| 5,438,310 | A * | 8/1995 | Ikari | 337/208 |
| 5,643,693 | A * | 7/1997 | Hill et al. | 429/121 |
| 5,645,448 | A * | 7/1997 | Hill | 439/522 |
| 5,805,047 | A * | 9/1998 | De Villeroche et al. | 337/290 |
| 5,886,611 | A * | 3/1999 | Schaller et al. | 337/189 |
| 6,222,439 | B1 | 4/2001 | Tanigawa et al. | |

(Continued)

FOREIGN PATENT DOCUMENTS

| | | |
|---|---|---|
| CN | 1155038 C | 6/2004 |
| EP | 0936647 A2 | 8/1999 |

(Continued)

OTHER PUBLICATIONS

International Search Report (PCT/ISA/210), issued by the International Searching Authority in corresponding International Application No. PCT/JP2011/059122 on Jul. 15, 2011.

(Continued)

*Primary Examiner* — Anatoly Vortman
(74) *Attorney, Agent, or Firm* — Sughrue Mion, PLLC

(57) ABSTRACT

A fuse unit includes a feeding terminal, an energizing terminal and a fusion portion. The feeding terminal is fixed to a battery post to receive power from a battery. The fusion portion electrically connects the feeding terminal and the energizing terminal, and is arranged over the battery post. The feeding terminal is positioned between the energizing terminal and the fusion portion.

4 Claims, 10 Drawing Sheets

(56) References Cited

U.S. PATENT DOCUMENTS

| | | | | |
|---|---|---|---|---|
| 6,294,978 | B1 * | 9/2001 | Endo et al. | 337/166 |
| 6,476,705 | B1 * | 11/2002 | Betti et al. | 337/161 |
| 6,509,824 | B2 * | 1/2003 | Inaba et al. | 337/295 |
| 6,512,443 | B1 * | 1/2003 | Matsumura et al. | 337/189 |
| 6,806,421 | B2 * | 10/2004 | Matsumura | 174/50 |
| 6,902,434 | B2 * | 6/2005 | Stack | 439/620.28 |
| 7,046,115 | B2 * | 5/2006 | Higuchi et al. | 337/193 |
| 7,176,780 | B2 * | 2/2007 | Iwata | 337/188 |
| 7,292,130 | B2 * | 11/2007 | Taga et al. | 337/159 |
| 7,420,453 | B2 * | 9/2008 | Matsumura et al. | 337/295 |
| 7,663,466 | B1 * | 2/2010 | Jetton | 337/191 |
| 7,924,137 | B2 * | 4/2011 | Rahman et al. | 337/187 |
| 7,978,046 | B2 * | 7/2011 | Ohashi et al. | 337/186 |
| 8,721,367 | B2 * | 5/2014 | Matsumoto et al. | 439/620.26 |
| 8,821,190 | B2 * | 9/2014 | Matsumura et al. | 439/620.27 |
| 2003/0022536 | A1 * | 1/2003 | Saito et al. | 439/76.2 |
| 2004/0115991 | A1 * | 6/2004 | Higuchi et al. | 439/621 |
| 2004/0132335 | A1 * | 7/2004 | Kosuge | 439/522 |
| 2005/0116805 | A1 | 6/2005 | Taga et al. | |
| 2005/0285709 | A1 | 12/2005 | Matsumura et al. | |
| 2007/0241857 | A1 | 10/2007 | Ito et al. | |
| 2012/0020036 | A1 * | 1/2012 | Matsumoto | 361/752 |

FOREIGN PATENT DOCUMENTS

| | | | |
|---|---|---|---|
| EP | 1075012 | A2 | 2/2001 |
| EP | 1548785 | A1 | 6/2005 |
| JP | 2001-054223 | A | 2/2001 |
| JP | 2009-289602 | A | 12/2009 |

OTHER PUBLICATIONS

Written Opinion (PCT/ISA/237) of the International Searching Authority, issued in corresponding International Application No. PCT/JP2011/059122 on Jul. 15, 2011.

Office Action dated Jul. 2, 2014, issued by the State Intellectual Property Office of the People's Republic of China in counterpart Chinese Application No. 201180017928.5.

* cited by examiner

FUSE UNIT

CROSS REFERENCE RELATED APPLICATIONS

The present application is based on Japanese Patent Application No. 2010-087847 filed on Apr. 6, 2010, the contents of which are incorporated herein by way of reference.

TECHNICAL FIELD

The present invention is related to a fuse unit directly mounted on a battery post.

BACKGROUND ART

Various fuse units directly mounted on battery posts are proposed conventionally (see JP-A-2009-289602). One conventional example of this kind of fuse unit is shown in FIGS. 8 to 12. As shown in FIGS. 8 to 12, a fuse unit 60 is fixed to a battery post 52 of a battery 51 via a battery-connecting terminal 53. The fuse unit 60 is arranged on an upper surface 510 of the battery 51. The fuse unit 60 includes a bus bar 61 which is a plate material of a conductor, and an insulative portion 70 provided so as to cover a suitable portion of an outer periphery of this bus bar 61.

The bus bar 61 has a power-feeding terminal 62 to which the battery-connecting terminal 53 is fixed, two energizing terminals 63 to which two load side terminals (not shown in FIGS. 8 to 12) are respectively connected. Two fusion portions 64 are respectively interposed between the power-feeding terminal 62 and the two energizing terminals 63. A bolt insertion hole 62*a* is formed in the power-feeding terminal 62. The battery-connecting terminal 53 is connected to the power-feeding terminal 62 with a bolt 71 and a nut 72. The two fusion portions 64 are respectively extended from opposite side ends of the power-feeding terminal 62 and are arranged parallel to each other. The two energizing terminals 63 are extended respectively from the fusion portions 64 and are arranged along a longitudinal direction of each of the fusion portions 64. A bolt insertion hole 63*a* is formed in each of the energizing terminals 63 and also, a bolt 63*b* inserted into the bolt insertion hole 63*a* is provided on each of the energizing terminals 63. The load side terminals (not shown in FIGS. 8 to 12) are connected to respectively the energizing terminals 63 by nut tightening.

The insulative portion 70 is formed by insert molding on portions of the bus bar 61 excluding the fusion portions 64 and predetermined portions of the terminals 62, 63.

Incidentally, numeral 80 is a fusion portion cover.

SUMMARY OF INVENTION

Technical Problem

In the fuse unit 60 directly mounted on the battery 51, a position of the power-feeding terminal 62 is determined by the battery-connecting terminal 53. Therefore, in the fuse unit 60 of the above conventional example in which the fusion portions 64 are arranged on the opposite side ends of the power-feeding terminal 62 and juxtaposed thereto, and in which the energizing terminals 63 are respectively arranged on end portions of each of the fusion portions 64, that are opposite to the portions connecting to the power-feeding terminal 62, a dimension L2 from the center line of the bolt insertion hole of the power-feeding terminal 62 to the top of each of the energizing terminals 63 becomes long and the fuse unit 60 is upsized and the fuse unit 60 greatly protrudes from a side surface 51*b* of the battery 51. Also, the fusion portions 64 and the energizing terminals 63 are arranged in positions of opposite side ends of the power-feeding terminal 62, so that a dimension W2 of a width direction of the fuse unit 60 becomes wide and the fuse unit 60 is upsized.

When the fuse unit 60 is upsized thus, space overhanging from the side surface 51*b* of the battery 51 increases as shown in FIGS. 9 and 10. There is a problem that the fuse unit 60 cannot be installed when large space cannot be obtained in the outside of the side surface 51*b* over the upper surface 51*a* of the battery 51 due to limitations of vehicle layout.

Also, the battery-connecting terminal 53 and the fuse unit 60 are fixed to the battery post 52 in a cantilevered manner, so that bending moment resulting from both of the battery-connecting terminal 53 and the fuse unit 60 acts on the battery post 52. Here, in the fuse unit 60 of the above conventional example, the fusion portions 64 are arranged on the opposite side ends of the power-feeding terminal 62 and juxtaposed thereto, and in which the energizing terminals 63 are respectively arranged on end portions of the fusion portions 64, so that there is a problem that a position of the center of gravity of the fuse unit 60 is set in a position greatly distant from the battery post 52 and great bending moment acts on the battery post 52 and a high load is applied to the battery post 52.

It is therefore one advantageous aspect of the present invention to provide a compact fuse unit capable of reducing a load on a battery post.

Solution to Problem

According to one aspect of the present invention, there is provided a fuse unit, comprising:

a feeding terminal fixed to a battery post to receive power from a battery;

an energizing terminal; and a fusion portion, electrically connecting the feeding terminal and the energizing terminal, and arranged over the battery post, wherein the feeding terminal is positioned between the energizing terminal and the fusion portion.

The fuse unit may further comprise: a bus bar having the feeding terminal, the energizing terminal and the fusion portion; and an insulative portion arranged at a periphery of the bus bar. A part of the bus bar between the fusion portion and the energizing terminal may be formed as a vertical plate part by vertically folded.

The energizing terminal may be horizontally formed by folding a part of the vertical plate part to a side of the feeding terminal.

Advantageous Effects of Invention

According to the present invention, since the fusion portion and the energizing terminal are mutually arranged oppositely with the feeding terminal sandwiched, a dimension from the feeding terminal to the top of the energizing terminal becomes short, so that the fuse unit becomes compact and the amount overhanging from a side surface of the battery can be minimized. Also, since the fusion portion is positioned over the battery post, a position of the center of gravity of the fuse unit is set in a position near to the battery post and only small bending moment acts on the battery post and a load on the battery post can be reduced.

According to the present invention, since the fusion portion and the energizing terminal are coupled at the amount of thickness of the bus bar, a dimension of a width direction of the fuse unit becomes small, so that the fuse unit becomes more compact and a width overhanging from the side surface of the battery can be minimized.

According to the present invention, since the energizing terminal is arranged inward from the vertical plate part, the fuse unit becomes more compact.

DESCRIPTION OF EMBODIMENTS

Exemplified embodiments of the invention will be described below in detail with reference the accompanying drawings.

Figure 1:
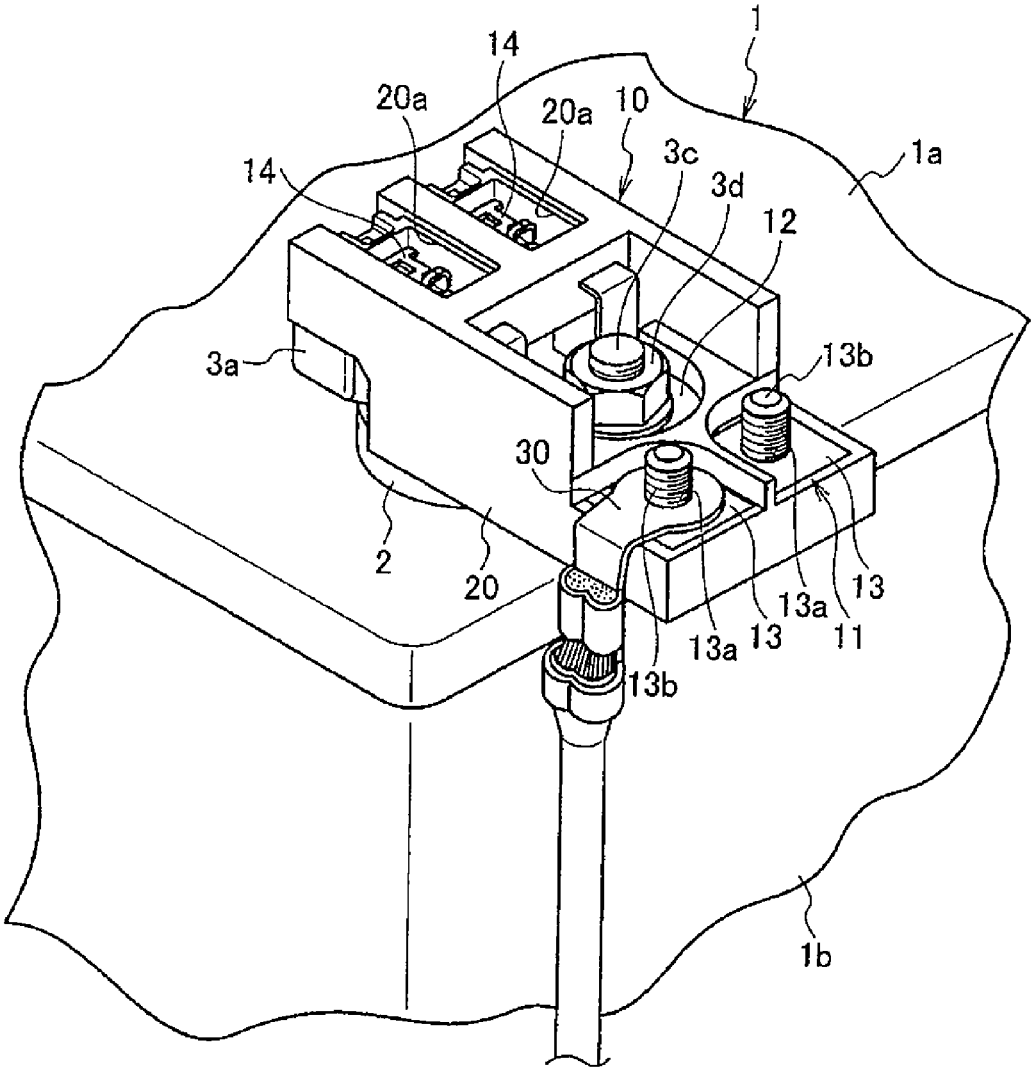
FIG. 1 is a perspective view of a fuse unit according to an embodiment of the present invention.
Figure 2:
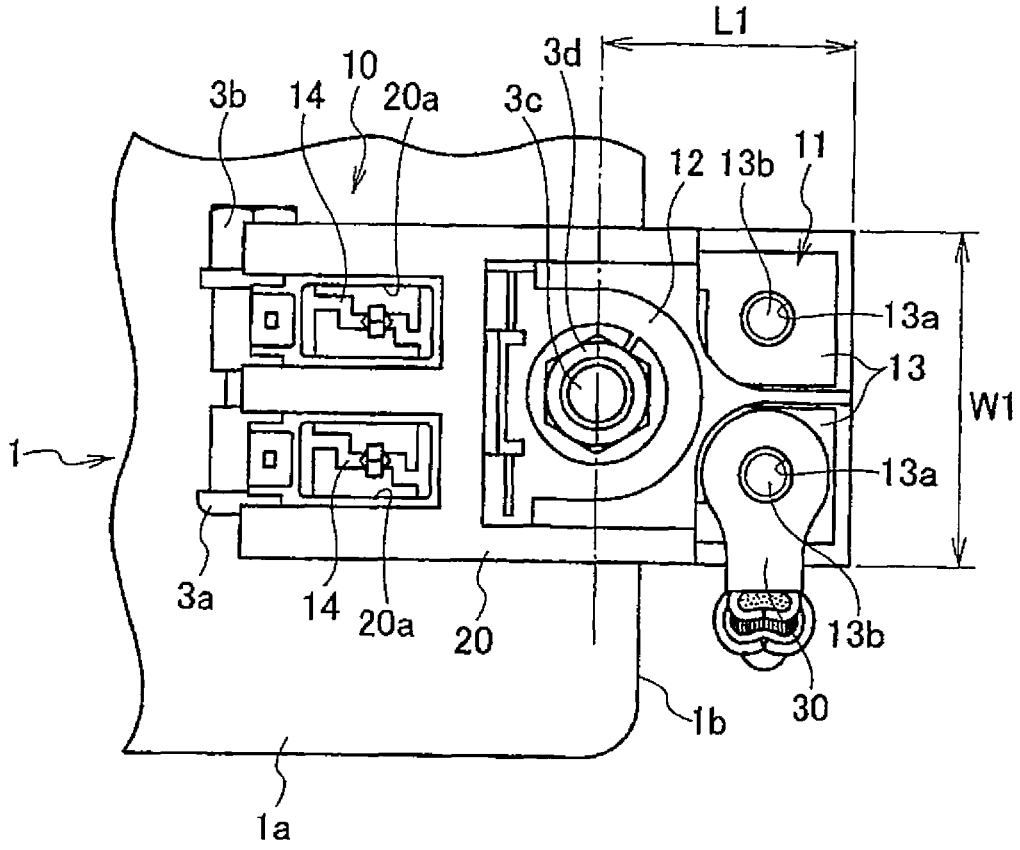
FIG. 2 is a plan view of the fuse unit shown in FIG. 1 directly mounted on the battery.
Figure 3:
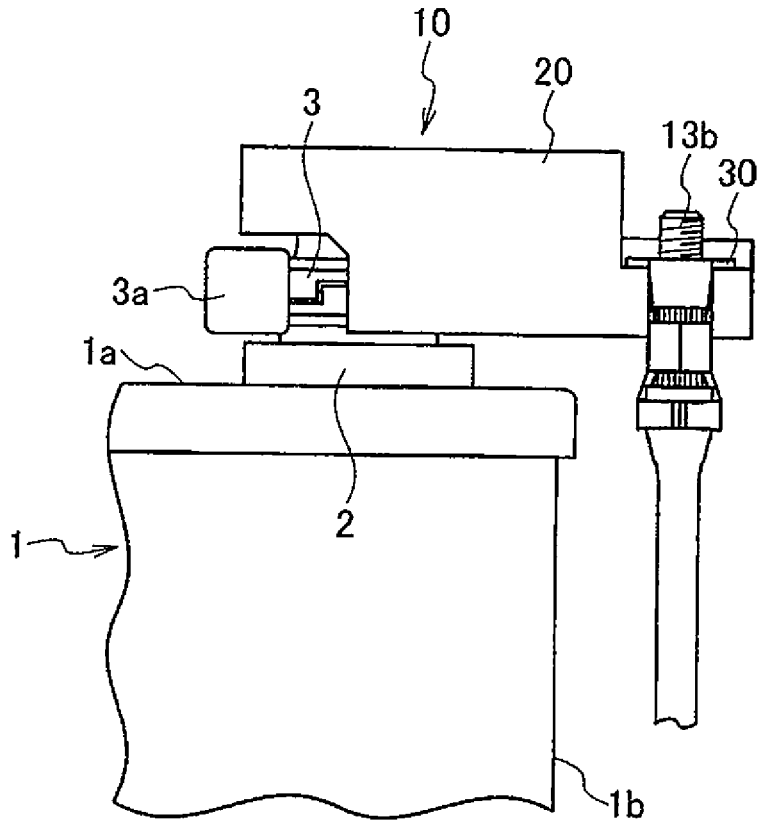
FIG. 3 is a side view of the fuse unit shown in FIG. 1 directly mounted on the battery.
Figure 4:
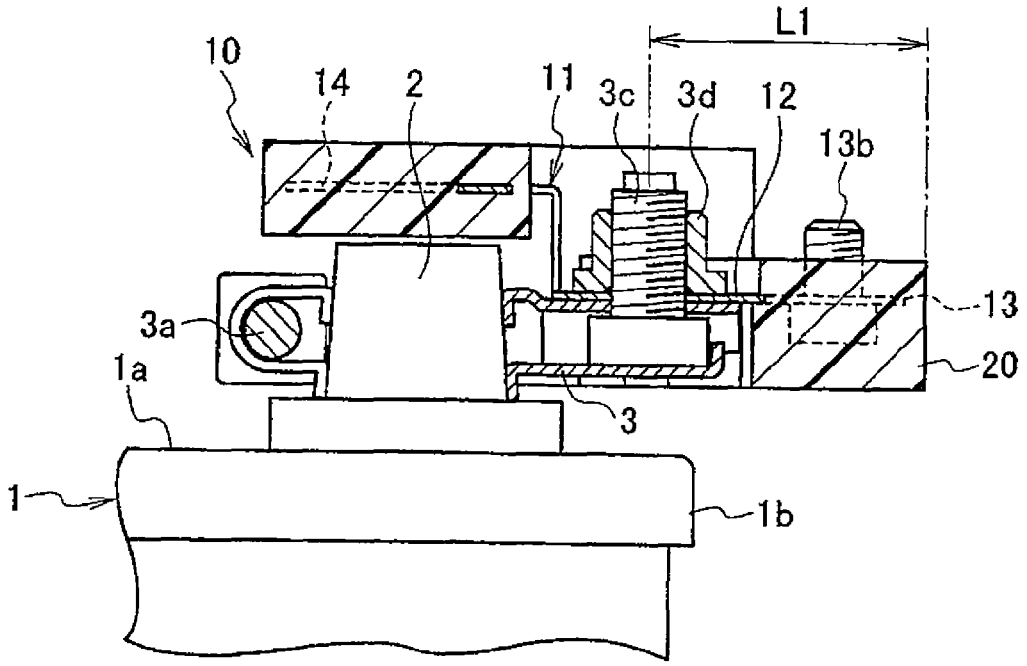
FIG. 4 is a sectional view of the fuse unit shown in FIG. 1 directly mounted on the battery.
Figure 5:
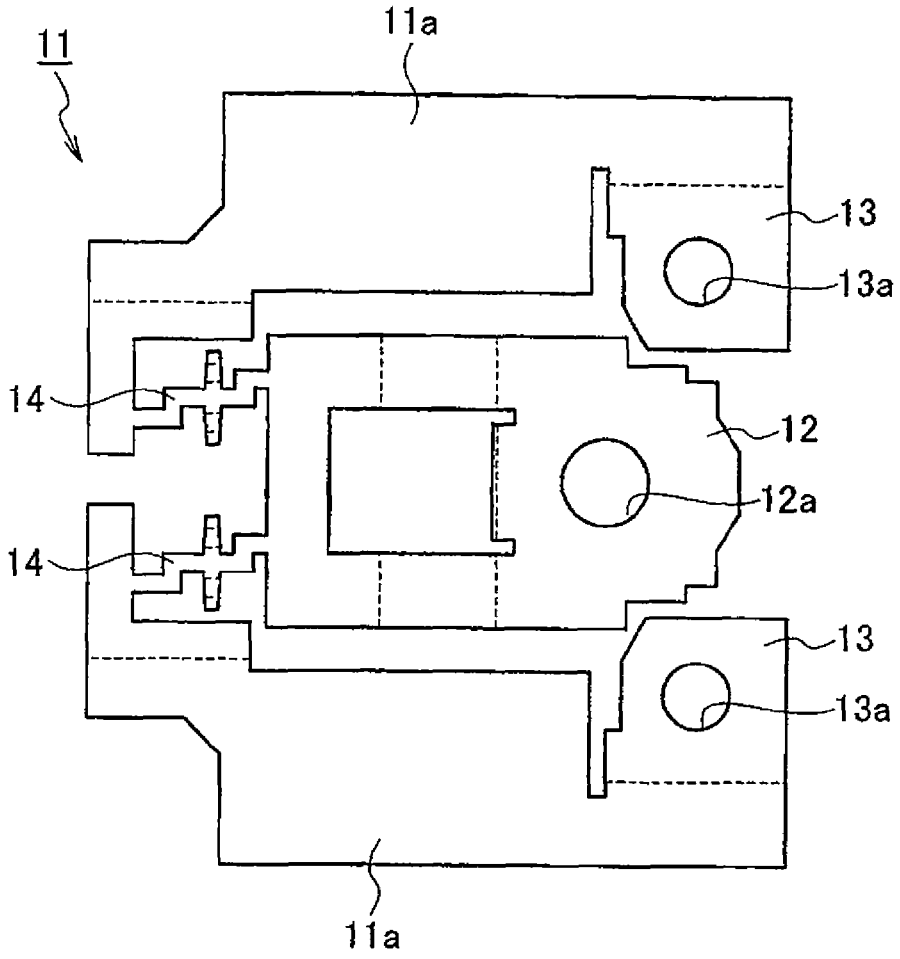
FIG. 5 is a plan view of a bus bar of the fuse unit shown in FIG. 1 before folding processing.
Figure 6:
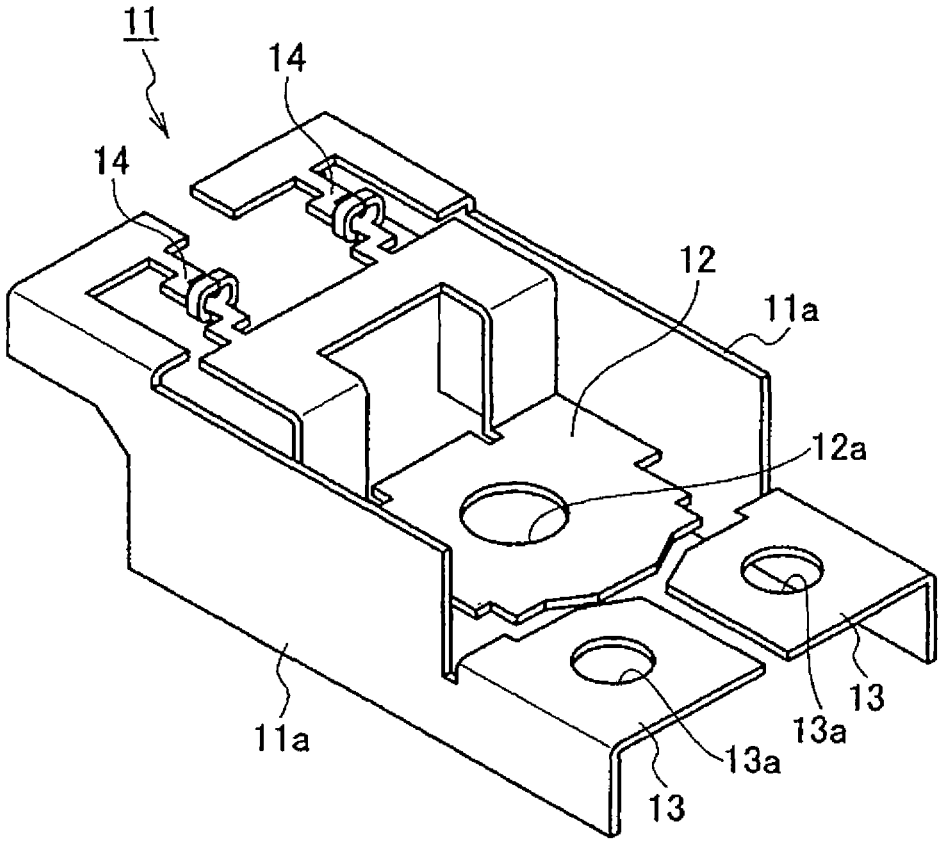
FIG. 6 is a perspective view of the bus bar shown in FIG. 5 after folding processing.
Figure 7:
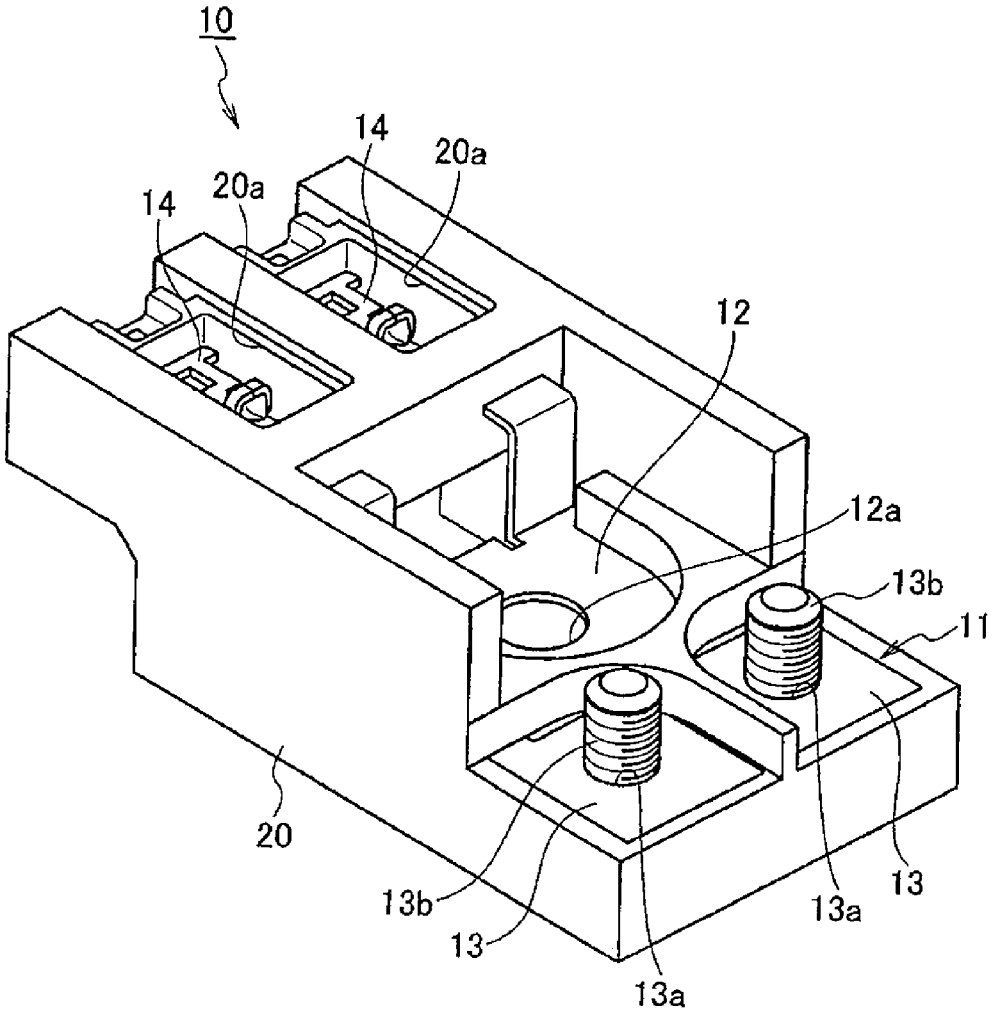
FIG. 7 is a perspective view of the fuse unit shown in FIG. 1.
Figure 8:
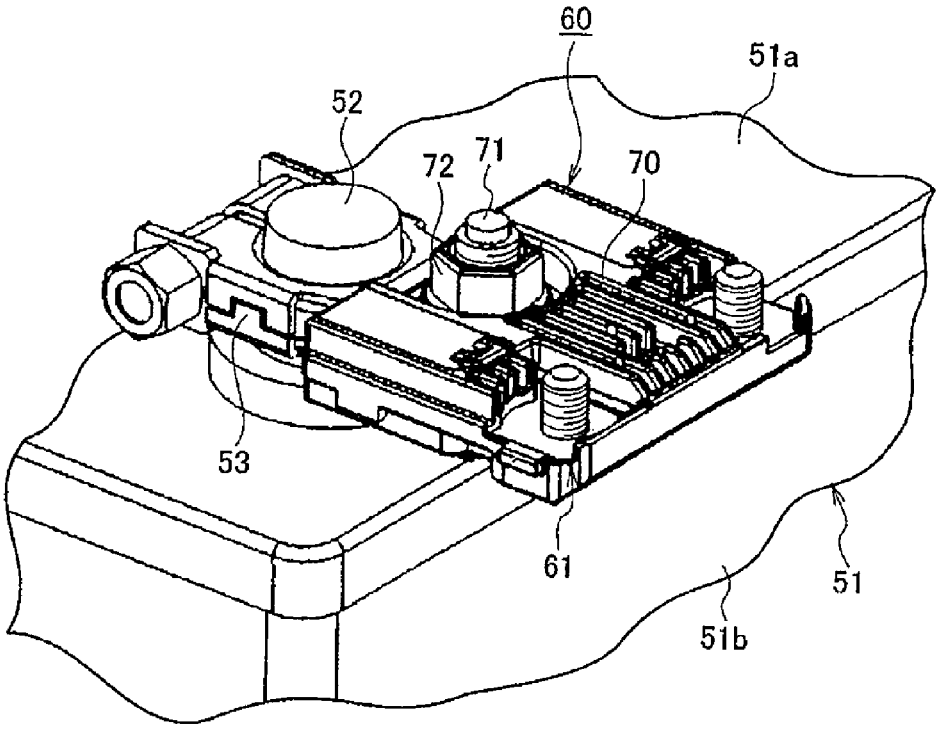
Fig. 8 (Prior Art)
FIG. 8 is a perspective view of a fuse unit according to a conventional example.
Figure 9:
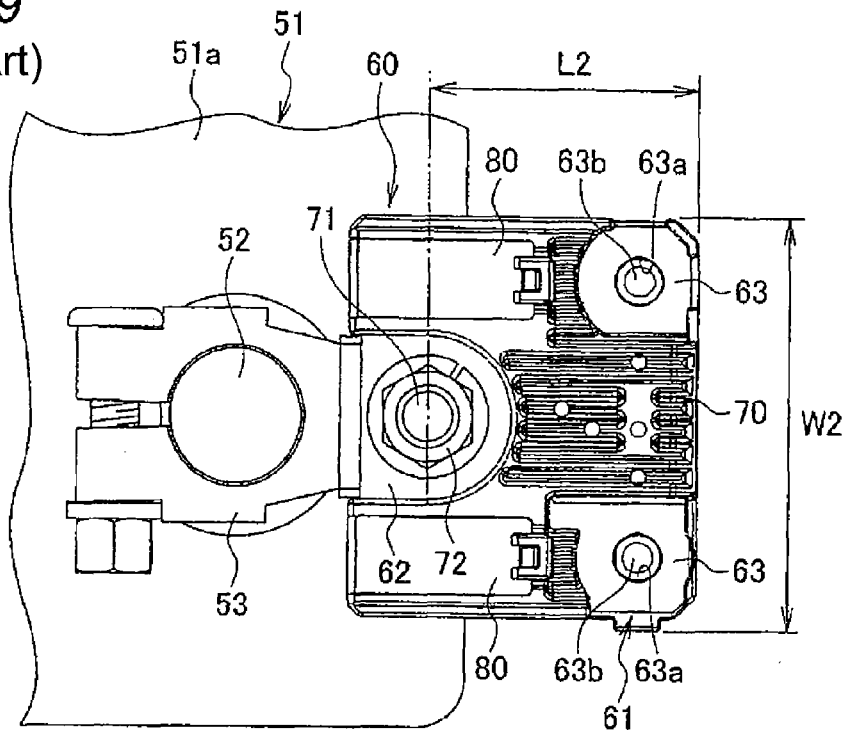
Fig. 9 (Prior Art)
FIG. 9 is a plan view of the fuse unit shown in FIG. 8 directly mounted on the battery.
Figure 10:
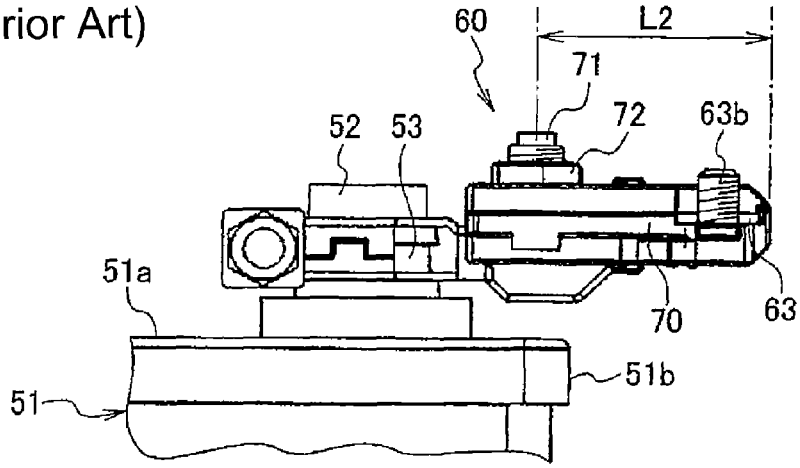
Fig. 10 (Prior Art)
FIG. 10 is a side view of the fuse unit shown in FIG. 8 directly mounted on the battery.
Figure 11:
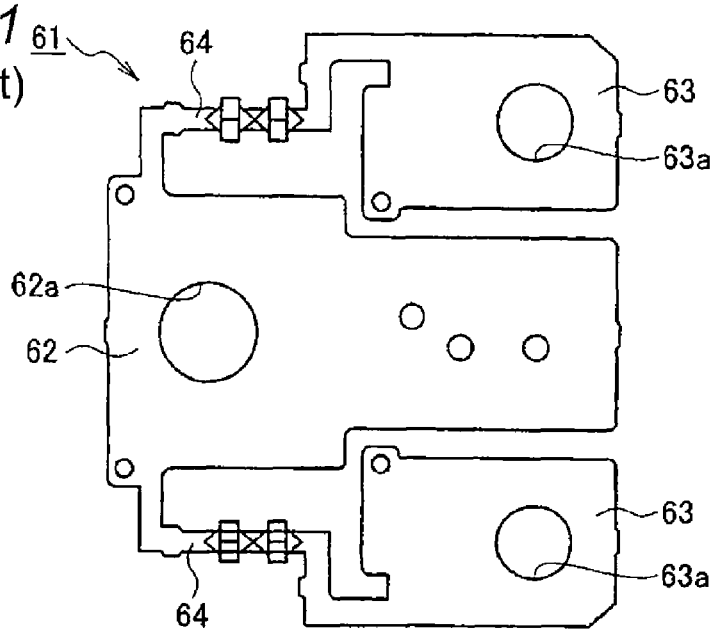
Fig. 11 (Prior Art)
FIG. 11 is a plan view of a bus bar of the fuse unit shown in FIG. 8.
Figure 12:
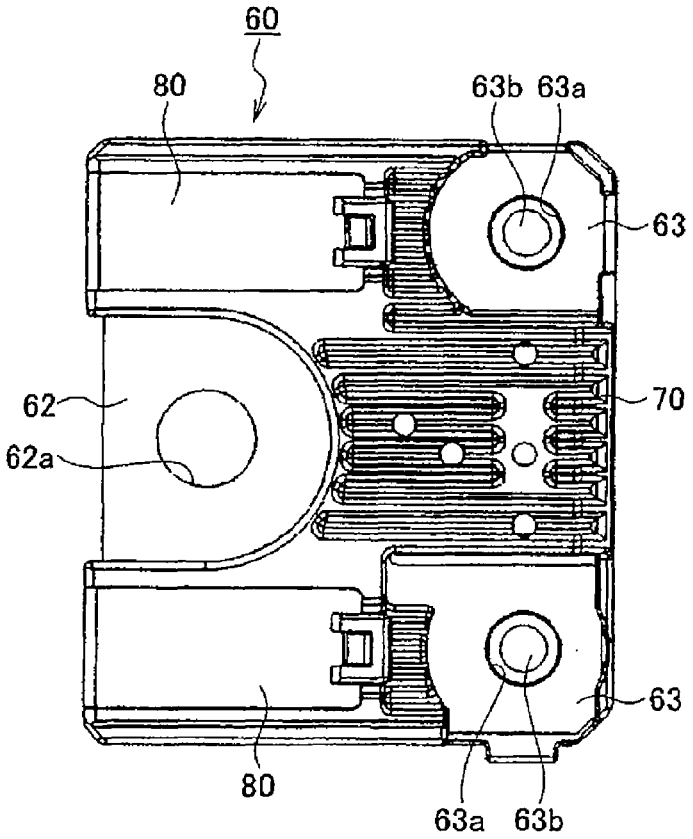
Fig. 12 (Prior Art)
FIG. 12 is a plan view of the fuse unit shown in FIG. 8.

FIGS. 1 to 7 show an embodiment of the invention. FIG. 1 is a perspective view of a fuse unit 10 directly mounted on a battery 1. FIG. 2 is a plan view of the fuse unit 10 directly mounted on the battery 1. FIG. 3 is a side view of the fuse unit 10 directly mounted on the battery 1. FIG. 4 is a sectional view of the fuse unit 10 directly mounted on the battery 1. FIG. 5 is a plan view of a bus bar 11 before folding processing. FIG. 6 is a perspective view of the folded bus bar 11. FIG. 7 is a perspective view of the fuse unit 10.

In FIGS. 1 to 4, a battery post 2 is protruded on an upper surface 1*a* of the vehicle-mounted battery 1. The fuse unit 10 is fixed to the battery post 2 through a battery-connecting terminal 3. The fuse unit 10 is arranged on the upper surface 1*a* of the battery 1.

A place between the battery post 2 and the battery-connecting terminal 3 is fixed by a nut 3*b* and a bolt 3*a* annexed to the battery-connecting terminal 3. A fixing structure between the battery-connecting terminal 3 and the fuse unit 10 will be described below.

The fuse unit 10 includes the bus bar 11 which is a plate material of a conductor, and an insulative portion 20 provided so as to cover an outer periphery of this bus bar 11. The insulative portion 20 is made of resin for example.

The bus bar 11 has a power-feeding terminal 12 to which the battery-connecting terminal 3 is fixed, two energizing terminals 13 to which two load side terminals 30 are respectively connected, and two fusion portions 14 interposed between the power-feeding terminal 12 and each of the energizing terminals 13 as specifically shown in FIGS. 5 and 6. That is, the fusion portions 14 electrically connect the power-feeding terminal 12 and the energizing terminals 13.

A bolt insertion hole 12*a* is formed in the power-feeding terminal 12. A bolt 3*c* annexed to the battery-connecting terminal 3 is inserted into this bolt insertion hole 12*a* and a nut 3*d* is screwed into the inserted bolt 3*c* and thereby, the battery-connecting terminal 3 is connected. Both the two fusion portions 14 are extended from end faces of the side of the battery post 2 in the power-feeding terminal 12, and are disposed parallel each other in the side of the battery post 2 with reference to a position of the power-feeding terminal 12. The two fusion portions 14 are disposed in a position higher than the power-feeding terminal 12 by folding the bus bar 11, and are arranged over the battery post 2. Each of the fusion portions 14 is constructed by zigzag forming the bus bar 11 into a narrow shape over a certain distance and crimping and fixing a low-melting-point metal (not shown) in the narrow shape. Each of the fusion portions 14 fuses when a rated current or more is passed.

The two energizing terminals 13 are respectively disposed from each of the fusion portions 14 through vertical plate parts 11*a*. Each of the vertical plate parts 11*a* is vertically folded in the end side of each of the fusion portions 14, and is arranged along opposite side surfaces of the battery post 2. Then, each of the energizing terminals 13 is respectively disposed by being inward folded in the top side of each of the vertical plate parts 11*a*. A bolt insertion hole 13*a* is formed in each of the energizing terminals 13 and also, a bolt 13*b* inserted into the bolt insertion hole 13*a* is disposed. The load side terminal 30 is connected to each of the energizing terminals 13 by nut tightening.

The insulative portion 20 is formed by insert molding in a portion excluding the power-feeding terminal 12, the energizing terminals 13 and the fusion portions 14 of the bus bar 11. The power-feeding terminal 12, the energizing terminals 13 and the fusion portions 14 of the bus bar 11 are exposed from the insulative portion 20. Also, a window 20*a* is formed in a portion of each of the fusion portions 14. Each of the windows 20*a* is closed by a fusion portion cover (not shown).

Next, a procedure for manufacturing the fuse unit 10 will be described briefly. First, the flat bus bar 11 shown in FIG. 5 is made of a plate material of a conductor using a metallic mold (not shown) of the bus bar 11. Next, the bus bar 11 shown in FIG. 6 is made by performing folding processing for folding the flat bus bar 11 in places shown by imaginary lines in FIG. 5. A low-melting-point metal (not shown) is crimped and fixed to the fusion portions 14 in the case of this folding processing. Then, the bus bar 11 in which the bolt 13*b* is inserted into each of the bolt insertion holes 13*a* is set in a metallic mold (not shown) for insert molding, and insert molding of a synthetic resin material is performed. By this insert molding, the insulative portion 20 is formed on a predetermined outer surface of the bus bar 11. At least the head of each of the bolts 13*b* is buried in the insulative portion 20 and the bolt 13*b* is fixed. Consequently, the fuse unit 10 shown in FIG. 6 is made.

The fuse unit 10 made in the above manner is fixed to the battery post 2 on the battery 1 through the battery-connecting terminal 3 in a position in which the two fusion portions 14 are located over the battery post 2 as shown in FIGS. 1 to 4. The place between the battery post 2 and the battery-connecting terminal 3 is fixed by using the nut 3*b* and the bolt 3*a* annexed to the battery-connecting terminal 3. The battery-connecting terminal 3 is fixed to the fuse unit 10 by inserting the bolt 3*c* into the bolt insertion hole 12*a* of the power-feeding terminal 12 of the fuse unit 10 and tightening the nut 3*d* on the inserted bolt 3*c*.

As described above, in the fuse unit 10, the fusion portions 14 are arranged over the battery post 2 and the energizing terminals 13 are arranged in the side opposite to the fusion portions 14 with reference to the power-feeding terminal 12. In other words, the power-feeding terminal 12 is positioned between the energizing terminals 13 and the fusion portions 14. Since the fusion portions 14 and the energizing terminals 13 are mutually arranged oppositely with the power-feeding terminal 12 sandwiched thus, a dimension L1 from the power-feeding terminal 12 to the top of the energizing terminal 13 becomes short, so that the fuse unit 10 becomes compact and the amount overhanging from a side surface 1*b* of the battery 1 can be minimized. Also, since the fusion portions 14 are positioned over the battery post 2, a position of the center of gravity of the fuse unit 10 is set in a position near to the battery post 2 and only small bending moment acts on the battery post 2 and a load on the battery post 2 can be reduced.

The bus bar 11 having the power-feeding terminal 12, the energizing terminals 13 and the fusion portions 14 and the insulative portion 20 arranged so as to cover the outer periphery of the bus bar 11 are included, and places between the energizing terminals 13 and the fusion portions 14 of the bus bar 11 are constructed as the vertical plate parts 11*a* by being vertically folded. Therefore, since the places between the fusion portions 14 and the energizing terminals 13 can be coupled in space of the amount of thickness of the bus bar 11, a dimension W1 of a width direction of the fuse unit 10 becomes small, so that the fuse unit 10 becomes more compact and a width overhanging from the side surface 1*b* of the battery 1 can be minimized.

The energizing terminals 13 are constructed by being horizontally folded in a side (inside) of the power-feeding terminal 12 with respect to the vertical plate parts 11*a*. Therefore, since the energizing terminals 13 are arranged inward from the vertical plate parts 11*a*, the fuse unit 10 becomes more compact.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the inventions as defined by the appended claims.

For example, according to the embodiment described above, the fuse unit 10 includes the two fusion portions 14 and the two energizing terminals 13, but the invention can naturally be applied regardless of the number of fusion portions 14 and the number of energizing terminals 13.

INDUSTRIAL APPLICABILITY

The present invention is extremely useful in forming a compact fuse unit capable of reducing a load on a battery post.

REFERENCE SIGNS LIST

1 Battery
2 Battery Post
3 Battery-Connecting Terminal
10 Fuse Unit
11 Bus Bar
11*a* Vertical Plate Part
12 Power-Feeding Terminal
13 Energizing Terminal
14 Fusion Portion
20 Insulative Portion

The invention claimed is:

1. A fuse unit, comprising:

a feeding terminal having a bolt insertion hole through which a bolt is inserted in a height direction of the fuse unit so that the feeding terminal is fixed to a battery post to receive power from a battery;

an energizing terminal; and a fusion portion, electrically connecting the feeding terminal and the energizing terminal, wherein the feeding terminal is positioned between the energizing terminal and the fusion portion in a longitudinal direction of the fuse unit perpendicular to the height direction, and wherein, in the height direction, the battery is located below the battery post and the fusion portion is arranged above the battery post in a state in which the feeding terminal is fixed to the battery post.

2. The fuse unit according to claim 1, wherein the energizing terminal and the fusion portion are in alignment and the feeding terminal is between the energizing terminal and the fusion portion along the alignment.

3. A fuse unit, comprising:

a feeding terminal fixed to a battery post to receive power from a battery;

an energizing terminal; and a fusion portion, electrically connecting the feeding terminal and the energizing terminal and arranged over the battery post, a bus bar having the feeding terminal, the energizing terminal and the fusion portion; and an insulative portion arranged at a periphery of the bus bar, wherein the feeding terminal is positioned between the energizing terminal and the fusion portion, and wherein a part of the bus bar between the fusion portion and the energizing terminal is formed as a vertical plate part by vertical folding.

4. The fuse unit according to claim 3, wherein the energizing terminal is horizontally formed by folding a part of the vertical plate part to a side of the feeding terminal.

* * * * *